US008569962B2

(12) United States Patent
Hagino et al.

(10) Patent No.: US 8,569,962 B2
(45) Date of Patent: Oct. 29, 2013

(54) LED DRIVER CIRCUIT AND LED DRIVER SYSTEM

(75) Inventors: Hideyuki Hagino, Kumagaya (JP); Masahiro Shimozono, Kita Kyushu (JP); Shinichi Kiyota, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 236 days.

(21) Appl. No.: 13/233,291

(22) Filed: Sep. 15, 2011

(65) Prior Publication Data

US 2012/0139430 A1 Jun. 7, 2012

(30) Foreign Application Priority Data

Dec. 6, 2010 (JP) ..... 2010-271672

(51) Int. Cl.
*H05B 37/00* (2006.01)

(52) U.S. Cl.
USPC ..... 315/193; 315/186; 315/291

(58) Field of Classification Search
USPC ..... 315/185 R, 186, 192, 193, 291, 297, 315/307, 308
See application file for complete search history.

(56) References Cited

U.S. PATENT DOCUMENTS

| | | | | |
|---|---|---|---|---|
| 6,528,954 | B1 * | 3/2003 | Lys et al. | 315/291 |
| 6,791,397 | B2 | 9/2004 | Shimozono | |
| 6,822,403 | B2 * | 11/2004 | Horiuchi et al. | 315/307 |
| 2012/0119677 | A1 * | 5/2012 | Serdarevic et al. | 315/307 |

FOREIGN PATENT DOCUMENTS

| | | |
|---|---|---|
| JP | 4337339 | 9/2003 |
| JP | 2008-134288 | 6/2008 |

* cited by examiner

*Primary Examiner* — Tung X Le
(74) *Attorney, Agent, or Firm* — Sprinkle IP Law Group

(57) ABSTRACT

A withstand voltage of the LED driver circuit is set to be lower than an LED power supply voltage of the power supply and be higher than a first voltage value obtained by subtracting a voltage drop across whole of the LEDs connected in series caused by the second constant current from the LED power supply voltage.

When raising a luminous intensity of the LEDs, in response to the control signal, the control circuit controls the switch circuit to bring about conduction between the LED drive terminal and the first switch terminal to let the first constant current flow through the LEDs.

When lowering the luminous intensity of the LEDs, in response to the control signal, the control circuit controls the switch circuit to bring about conduction between the LED drive terminal and the second switch terminal to let the second constant current flow through the LEDs.

18 Claims, 9 Drawing Sheets

LED DRIVER CIRCUIT AND LED DRIVER SYSTEM

CROSS-REFERENCE TO RELATED APPLICATION

This application is based upon and claims the benefit of priority from the prior Japanese Patent Application No. 2010-271672, filed on Dec. 6, 2010, the entire contents of which are incorporated herein by reference.

BACKGROUND

1. Field

Embodiments described herein relate generally to an LED (Light Emitting Diode) Driver Circuit controlling an LED and an LED Driver system.

2. Background Art

Some conventional LED driver circuits include a constant current circuit for supplying a constant current to an LED connected to an external power supply, and a switch for controlling conduction and interception of the constant current to control lighting and extinguishment of the LED.

The constant current circuit is formed of, for example, an integrated circuit formed on a semiconductor substrate. It is supposed that the withstand voltage of this integrated circuit is, for example, 7 V and an operation voltage is 5 V. In this case, the operation voltage of the LED becomes approximately 3.5 V when the LED is lit (when a constant current of 20 mA is let flow).

In this case, the external power supply connected to the LED needs to output a power supply voltage of at least 8.5 V, which is the sum of the operation voltage 5 V of the integrated circuit and the operation voltage 3.5 V of the LED.

For example, when the constant current circuit is turned off, the current for driving the LED is lost and the voltage drop across the LED becomes 0 V. If the external power supply outputs a power supply voltage of 8.5 V, the voltage of 8.5 V is applied to the constant current circuit.

It is possible that the voltage applied to the constant voltage circuit will exceed the withstand voltage (7 V) of the LED driver circuit and, for example, dielectric breakdown of the constant current circuit will occur.

DETAILED DESCRIPTION

Figure 1:
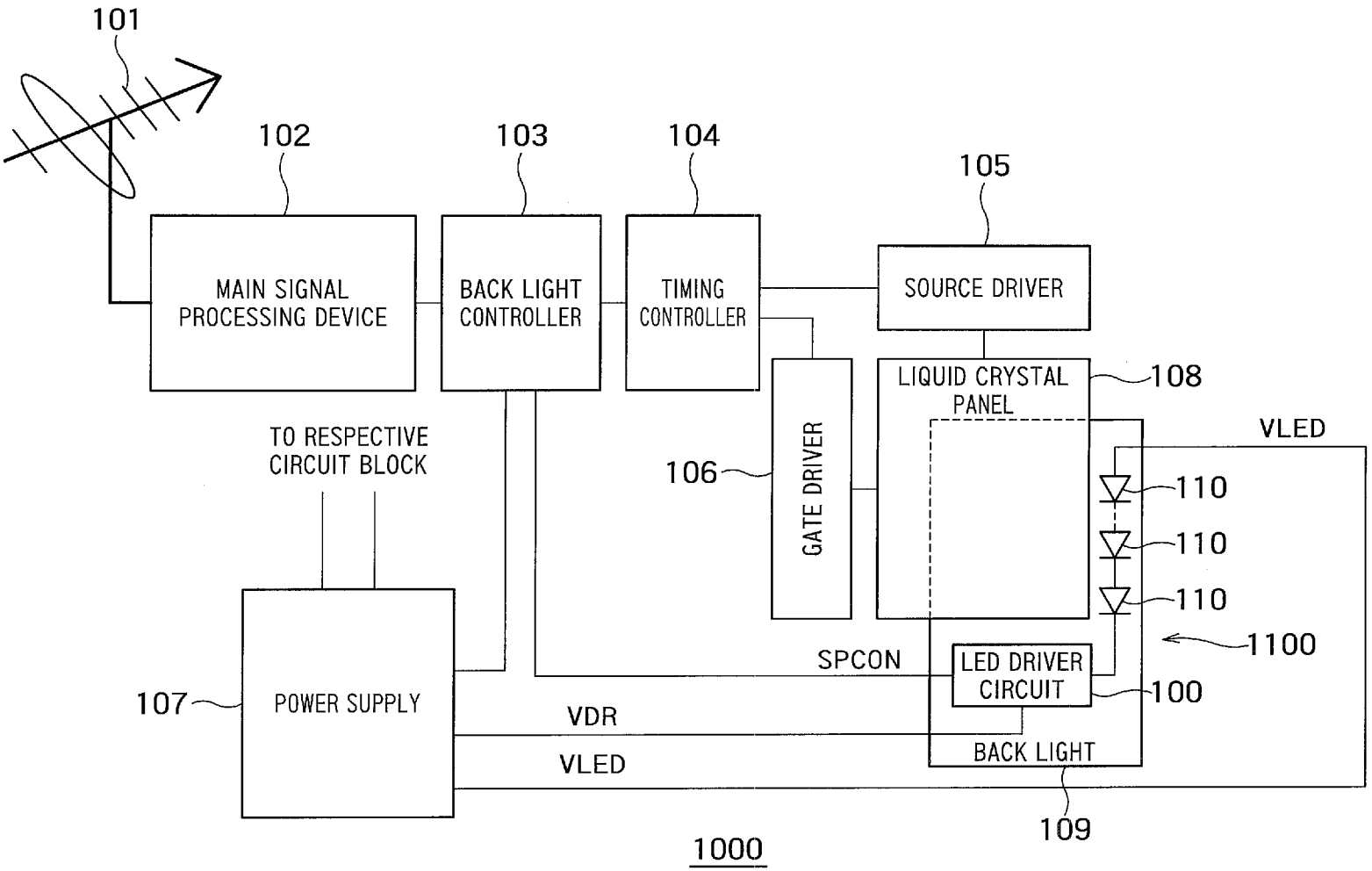
FIG. 1 is a block diagram showing an example of a configuration of a digital TV set 1000 including an LED driver circuit 100 according to an embodiment.

An LED driver circuit according to an embodiment, controls operation of a plurality of LEDs connected in series by controlling a current flowing through the plurality of LEDs, a first end of the LEDs connected in series being connected to a power supply. The LED driver circuit includes an LED drive terminal connected to a second end of the LEDs connected in series. The LED driver circuit includes a switch circuit which has a first switch terminal and a second switch terminal, and which brings about conduction only in one of between the LED drive terminal and the first switch terminal, and between the LED drive terminal and the second switch terminal. The LED driver circuit includes a first constant current circuit connected between the first switch terminal and ground to output a first constant current to be let flow through the LEDs. The LED driver circuit includes a second constant current circuit connected between the second switch terminal and the ground to output a second constant current, the second constant current being smaller than the first constant current. The LED driver circuit includes a control circuit which controls the switch circuit in response to a control signal for controlling a luminous intensity of the LEDs.

A withstand voltage of the LED driver circuit is set to be lower than an LED power supply voltage of the power supply and be higher than a first voltage value obtained by subtracting a voltage drop across whole of the LEDs connected in series caused by the second constant current from the LED power supply voltage.

When raising a luminous intensity of the LEDs, in response to the control signal, the control circuit controls the switch circuit to bring about conduction between the LED drive terminal and the first switch terminal to let the first constant current flow through the LEDs.

When lowering the luminous intensity of the LEDs, in response to the control signal, the control circuit controls the switch circuit to bring about conduction between the LED drive terminal and the second switch terminal to let the second constant current flow through the LEDs.

For example, for facilitating the control of the LED used in the back light or the like of digital TV sets, it is demanded to control a large number of LEDs with a smaller number of LED driver circuits. In response to this demand, the number of stages of LEDs connected in series tends to increase.

For driving LEDs connected in series in a multi-stage form in this way, the power supply voltage at the external power supply which supplies the drive voltage of the LEDs becomes further higher.

If high withstand voltage elements are applied to make the LED driver circuit cope with such a high power supply voltage, then the circuit area of the LED driver circuit increases and its manufacturing cost increases.

In each of embodiments, therefore, a configuration example of an LED driver circuit capable of controlling the operation of multi-stage LEDs connected in series with a lower withstand voltage will be described.

Hereafter, each of the embodiments will be described with reference to the drawings.

First Embodiment

FIG. 1 is a block diagram showing an example of a configuration of a digital TV set 1000 including an LED driver circuit 100 according to an embodiment.

As shown in FIG. 1, the digital TV set 1000 includes an antenna 101, a main signal processing device 102, a back light controller 103, a timing controller 104, a source driver 105, a gate driver 106, a power supply 107, a liquid crystal panel 108, and a back light 109.

The antenna 101 is adapted to receive a digital TV (television) signal.

The main signal processing device 102 is adapted to conduct processing on the received digital TV signal and output a predetermined signal.

The back light controller 103 is adapted to output a control signal SPCON for controlling brightness of the back light 109, in response to the output signal of the main signal processing device 102.

The timing controller 104 is adapted to output a signal for controlling operation of liquid crystal cells in the liquid crystal panel 108 to the source driver 105 and the gate driver 106.

The source driver 105 and the gate driver 106 control operation of liquid crystal cells in response to the signal which is output by the timing controller 104.

The back light 109 is adapted to supply light of a predetermined luminous intensity to the liquid crystal panel 108. The back light 109 includes the LED driver circuit 100 and a plurality of (n) LEDs 110.

The plurality of (n) LEDs 110 are connected in series, and a first end (an anode side) of the series connection is connected to the power supply 107 whereas a second end (a cathode side) of the series connection is connected to the LED driver circuit 100.

In FIG. 1, one set of the LED driver circuit 100 and a plurality of (n) LEDs 110 is shown as an example. As occasion demands, however, a plurality of sets are mounted on the back light 109.

The power supply 107 is adapted to generate and output a driver voltage VDR to be supplied to the LED driver circuit 100 in the back light 109, an LED power supply voltage VLED to be supplied to the LEDs 110 connected in series, and voltages to be supplied to other circuit blocks.

Figure 2:
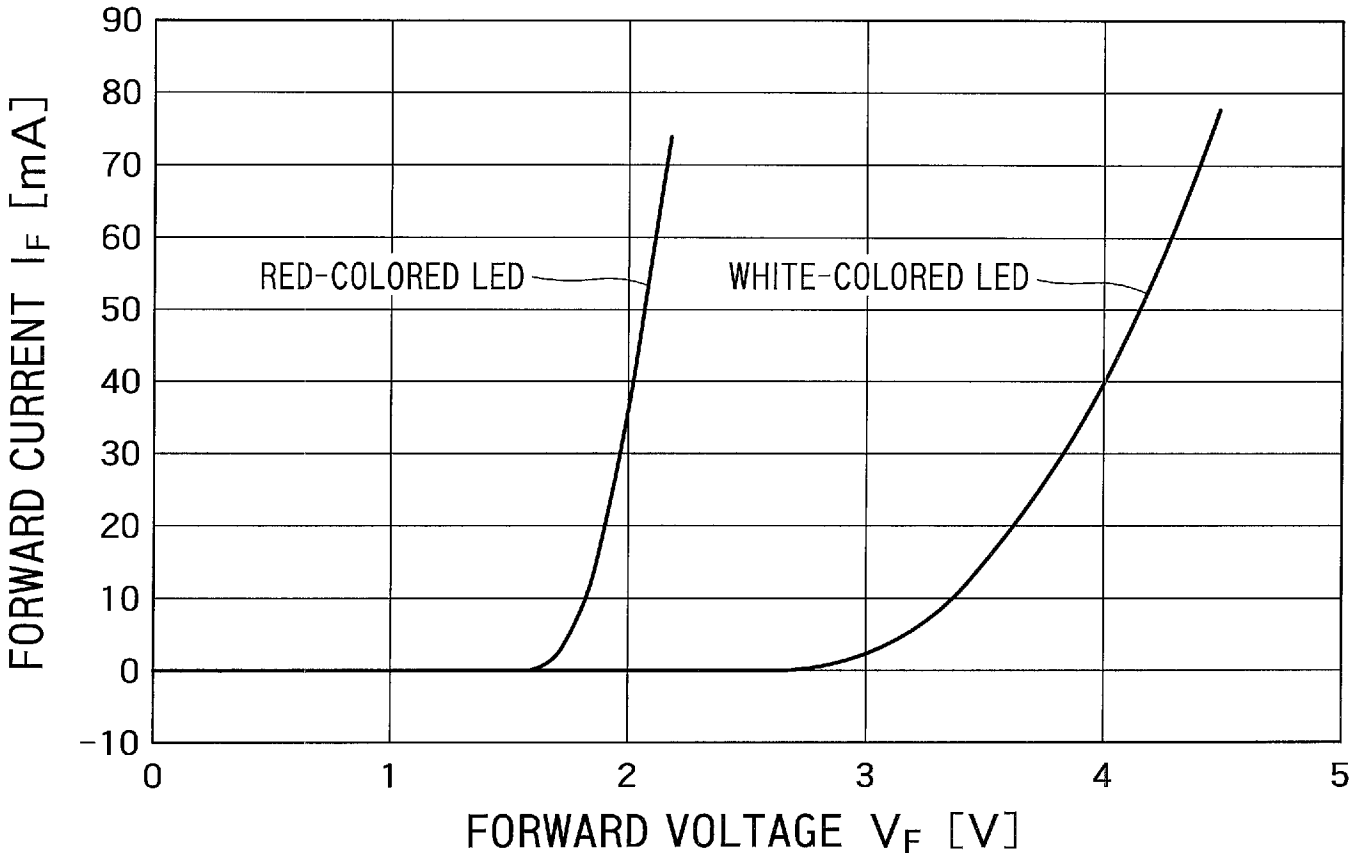
FIG. 2 is a diagram showing an example of a relation between a forward voltage VF and a forward current IF of an LED.

FIG. 2 is a diagram showing an example of a relation between a forward voltage VF and a forward current IF of an LED. In FIG. 2, characteristics of a red-colored LED and a white-colored LED are shown.

If the forward current IF flows, the forward voltage VF is generated as shown in FIG. 2. For example, in the white-colored LED used in the back light, the forward current IF flows when the forward voltage VF is at least 2.8 V (drive voltage).

Figure 3:
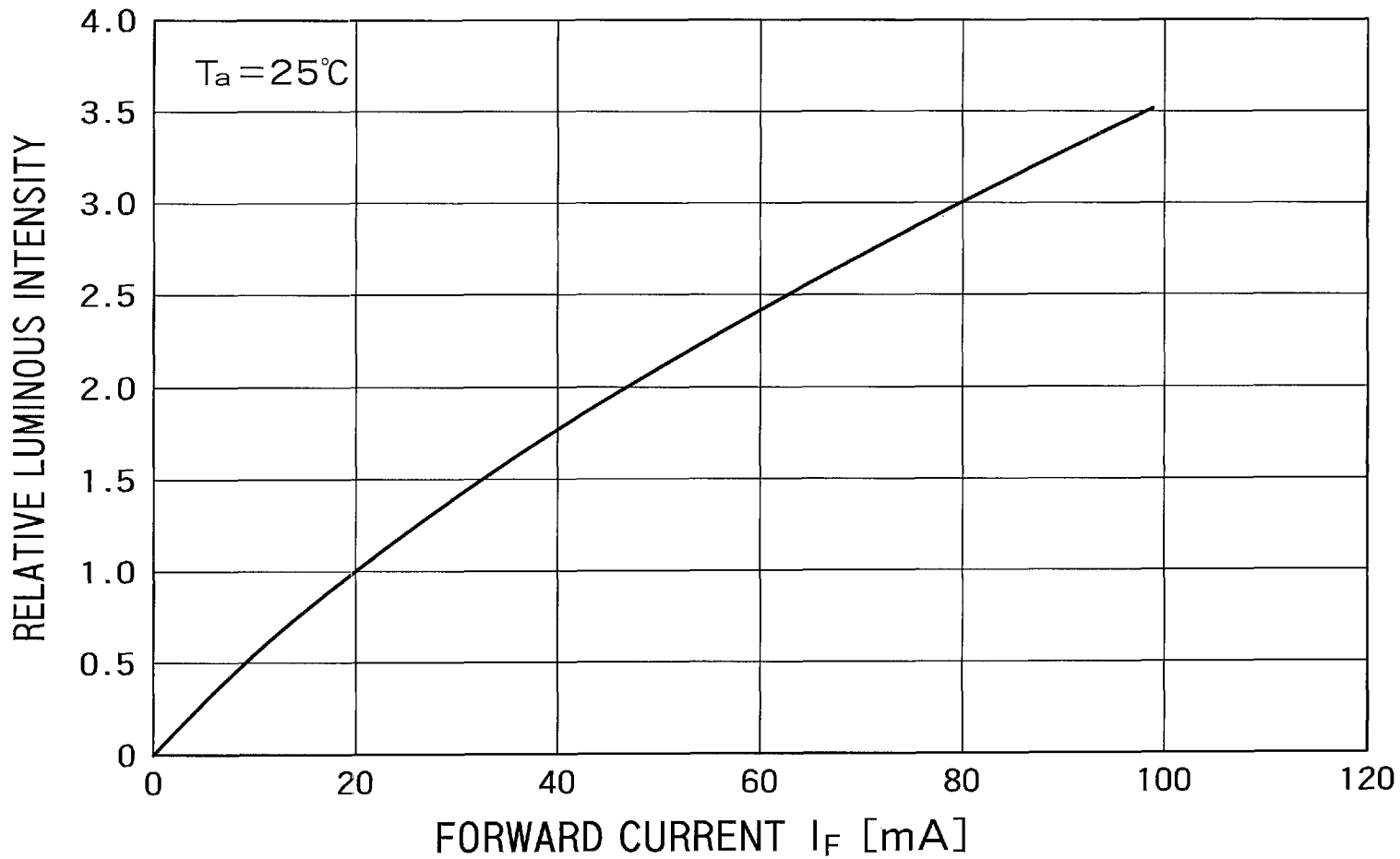
FIG. 3 is a diagram showing an example of a relation between the forward current IF and a relative luminous intensity of the LED.

FIG. 3 is a diagram showing an example of a relation between the forward current IF and a relative luminous intensity of the LED. In FIG. 3, the temperature of the LED is set to 25° C.

As shown in FIG. 3, the relative luminous intensity (brightness) of the LED is proportionate to the forward current IF.

The exemplary characteristics shown in FIGS. 2 and 3 are shown in Transistor Technique, February 2006, p. 129.

Figure 4:
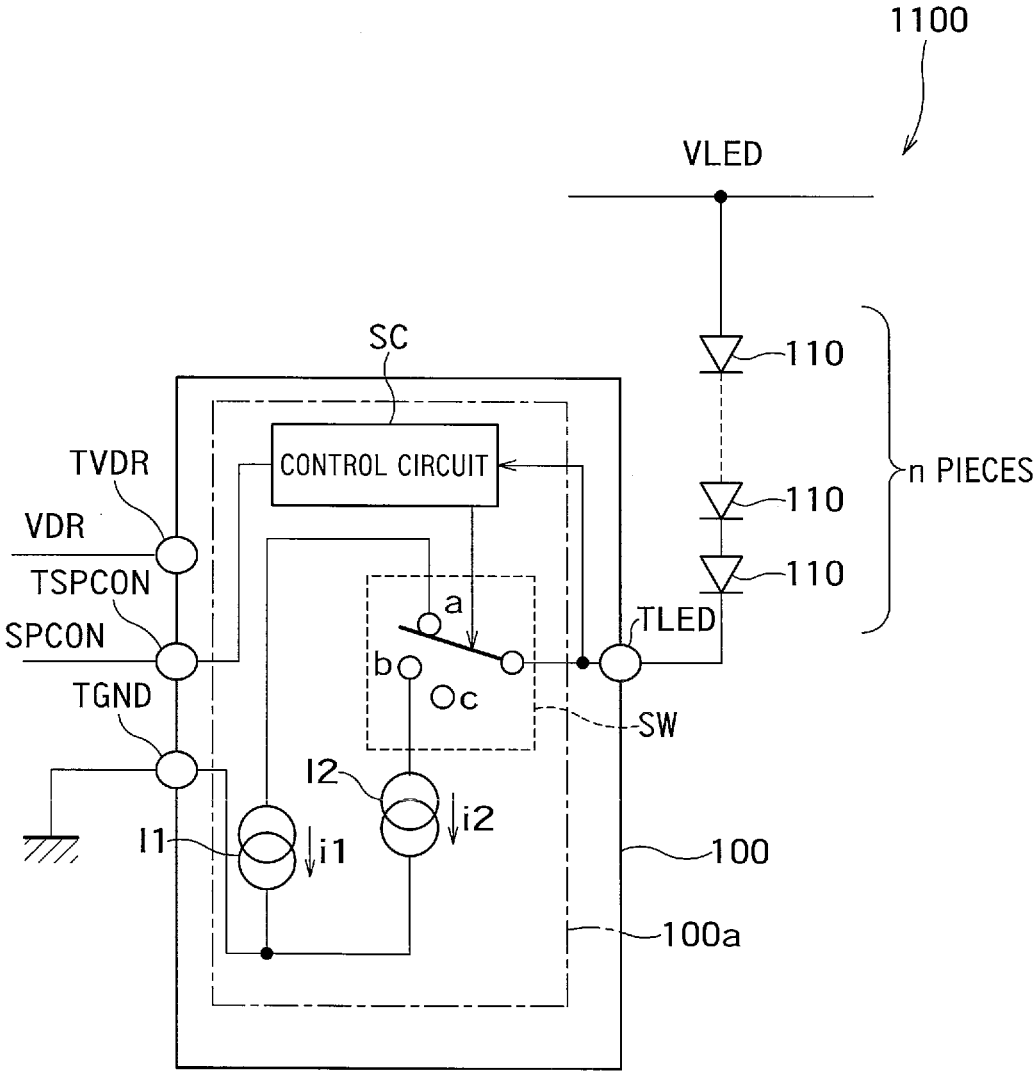
FIG. 4 is a diagram showing an example of a configuration of the LED driver circuit 100 shown in FIG. 1.

FIG. 4 is a diagram showing an example of a configuration of the LED driver circuit 100 shown in FIG. 1.

As shown in FIG. 4, the LED driver circuit 100 is adapted to control operation of the LEDs 110 by controlling the current flowing through the plurality of LEDs 110 connected in series and connected at the first end (anode side) of the series connection to the power supply 107.

The LED driver circuit 100 includes a power supply terminal TVDR, a ground terminal TGND, a control signal terminal TSPCON, an LED drive terminal TLED, a switch circuit SW, a first constant current circuit I1, a second constant current circuit I2, and a control circuit SC.

The power supply terminal TVDR is adapted to be connected to the power supply 107 and supplied with the driver power supply voltage VDR from the power supply 107. The LED driver circuit 100 is adapted to be driven with the driver power supply voltage VDR.

The ground terminal TGND is connected to the ground.

The control signal terminal TSPCON is adapted to be connected to the back light controller 103 and supplied with the control signal SPCON which is output by the back light controller 103 to control the brightness.

The LED drive terminal TLED is connected to the second end (cathode side) of the LEDs 110 connected in series.

The switch circuit SW has a first switch terminal "a" connected to a first end of the first constant current circuit I1, a second switch terminal "b" connected to a first end of the second constant current circuit I2, and a third switch terminal "c" in a floating state.

Note that the floating state refers to a state in which the third switch terminal is not connected to (is insulated from) other circuit elements or interconnections.

This switch circuit SW is adapted to bring about conduction in only one of between the LED drive terminal TLED and the first switch terminal "a," between the LED drive terminal TLED and the second switch terminal "b," and between the LED drive terminal TLED and the third switch terminal "c."

The first constant current circuit (constant current source) I1 is connected between the first switch terminal "a" and the ground (the ground terminal TGND). The first constant current circuit i1 is adapted to output a first current (constant current) i1 to be let flow through the LEDs 110.

The first constant current circuit i1 is, for example, a MOS transistor connected at its first end (source) to the first switch terminal "a," connected at its second end (drain) to the ground (the ground terminal TGND), and supplied at its gate with a control voltage to let the first current i1 flow.

The second constant current circuit I2 is connected between the second switch terminal "b" and the ground (the ground terminal TGND). The second constant current circuit I2 is adapted to output a second current (constant current) i2 to be let flow through the LEDs 110.

The second constant current circuit 12 is, for example, a MOS transistor connected at its first end (source) to the second switch terminal "b," connected at its second end (drain) to the ground (the ground terminal TGND), and supplied at its gate with a control voltage to let the second current i2 flow.

The control circuit SC is adapted to control the switch circuit SW in response to the control signal SPCON for controlling the luminous intensity of the LEDs 110.

When increasing the luminous intensity of the LEDs 110 in response to the control signal SPCON, the control circuit SC, for example, controls the switch circuit SW to bring about conduction between the LED drive terminal LED and the first switch terminal "a" and let the first current i1 flow through the LEDs 110.

On the other hand, when decreasing the luminous intensity of the LEDs 110 in response to the control signal SPCON, the control circuit SC, for example, controls the switch circuit SW to bring about conduction between the LED drive terminal LED and the second switch terminal "b" and let the first current i2 flow through the LEDs 110.

The withstand voltage of the LED driver circuit 100 is set to be lower than the LED power supply voltage VLED of the power supply 107. In addition, the withstand voltage of the LED driver circuit 100 is set to be higher than a first voltage value obtained by subtracting a voltage drop generated across the all LEDs 110 connected in series by the second current i2 from the LED power supply voltage VLED.

Note that a withstand voltage at the LED drive terminal TLED and a withstand voltage of the switch circuit SW are set to be lower than the LED power supply voltage VLED. In addition, the withstand voltage at the LED drive terminal TLED and the withstand voltage of the switch circuit SW are set to be higher than the first voltage value.

If the power supply 107 stops (turns off) supply of the LED power supply voltage VLED, then the control circuit SC controls the switch circuit SW to bring about conduction between the LED drive terminal TLED and the third switch terminal "c" and thereby cuts off the current flowing through the LEDs 110 to turn off the LEDs.

Note that the LED driver circuit 100 and the plurality of (n) LEDs 110 constitute an LED driver system 1100. Furthermore, the switch circuit SW, the first constant current circuit i1, the second constant current circuit 12, and the control circuit SC constitute a current switch circuit 100*a*.

A case where an operation voltage of the LED driver circuit 100 is 5 V, the withstand voltage of the LED driver circuit 100 is 7 V, and four LEDs 110 are connected in series will now be described specifically.

For example, if the first current i1 of 20 mA is let flow at the time of lighting control, then the whole voltage drop across the LEDs 110 connected in series becomes 3.5 V×4=14 V. Even if a voltage at the LED drive terminal TLED is 0 V, therefore, the LED power supply voltage VLED becomes 14 V.

On the other hand, if the current flowing through the LEDs 110 is cut off at the time of extinguishment control as in the conventional technique, then the voltage drop across the whole of the LEDs 110 connected in series also becomes 0 V and the voltage at the LED drive terminal TLED becomes 14 V. In other words, the withstand voltage 7V of the LED driver circuit 100 is exceeded.

In the present first embodiment, however, the voltage drop across one of the LEDs 110 can be made equal to 2.5 V at the time of extinguishment control by letting the second current i2 which is smaller than the first current i1 through the LEDs 110.

Therefore, the voltage drop across the whole of the LEDs 110 connected in series becomes 2.5 V×4=10 V. In other words, even if the LED power supply voltage VLED is 14 V, the voltage at the LED drive terminal TLED can be suppressed to 4 V (the first voltage value).

This voltage (4 V (the first voltage value)) at the LED drive terminal is a voltage lower than the withstand voltage 7 V of the LED driver circuit 100. Therefore, dielectric breakdown is not caused in the LED driver circuit 100.

An example of operation of the LED driver circuit 100 having the configuration described heretofore will now be described.

Figure 5:
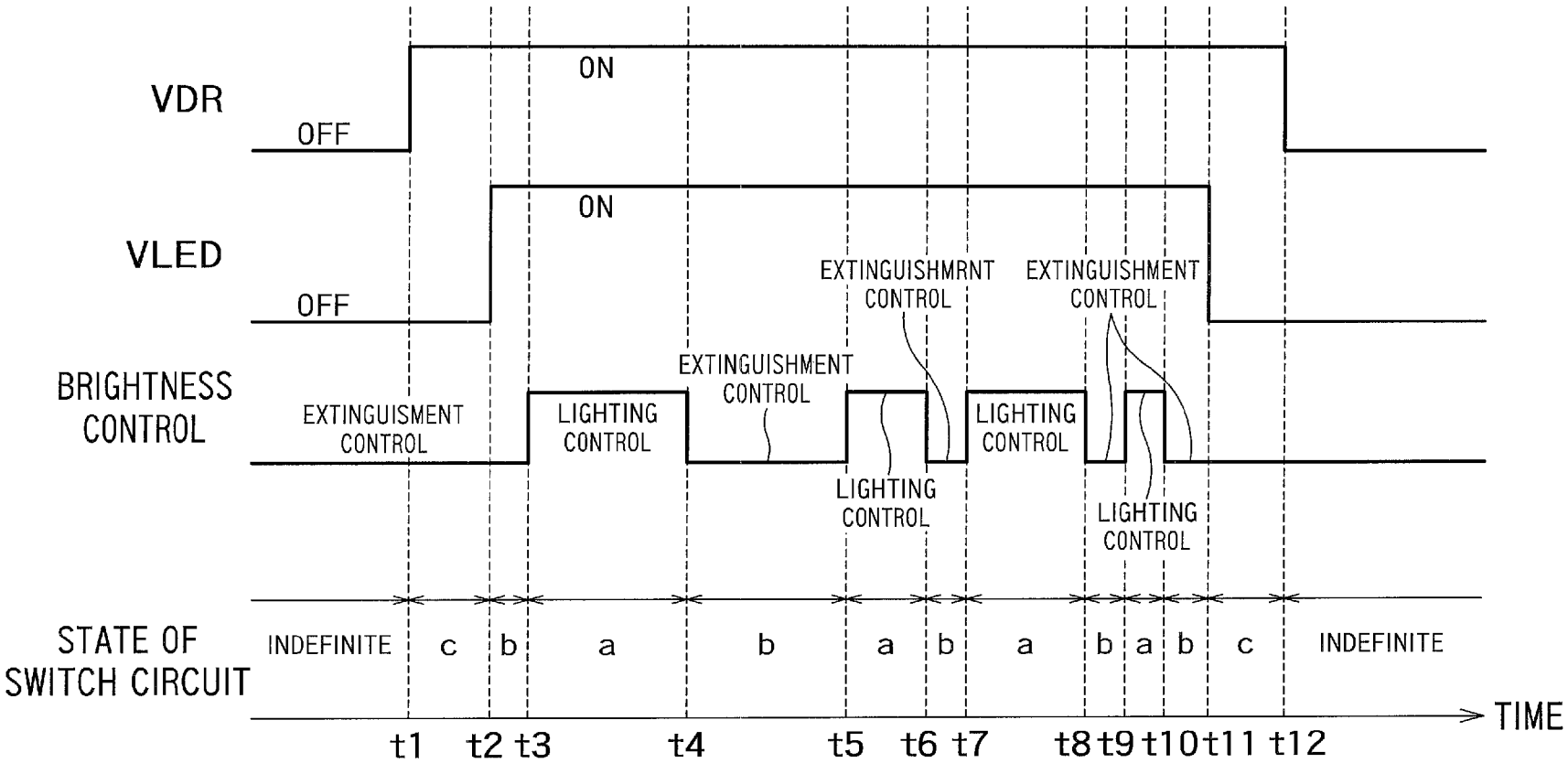
FIG. 5 is a diagram showing an example of relations between a signal which is input to the LED driver circuit 100 shown in FIG. 4 and changeover states of the switch circuit SW.

FIG. 5 is a diagram showing an example of relations between a signal which is input to the LED driver circuit 100 shown in FIG. 4 and changeover states of the switch circuit SW. In FIG. 5, the lighting control and the extinguishment control are indicated as the brightness control of the LEDs. The lighting control is control for letting the first current i1 flow through the LEDs and making the luminous intensity of the LEDs equal to a predetermined value. In the extinguishment control, there are two ways: (1) control for cutting off the current flowing through the LEDs and thereby turning off the LEDs completely; and (2) control for making the current flowing through the LEDs very small (letting the second current i2 flow through the LEDs) and making the luminous intensity of the LEDs very low.

As shown in FIG. 5, the power supply 107 has already stopped (turned off) supply of the driver power supply voltage VDR and the LED power supply voltage VLED before time t1 (extinguishment control (1). As a result, the LED driver circuit 100 is in the operation stop state, and the changeover state of the switch circuit SW is in an indefinite state.

Since the power supply 107 stops (turns off) the supply of the LED power supply voltage VLED, the LED drive terminal TLED is supplied with, for example, the ground voltage (0 V).

In a time period between time t1 and t2 (extinguishment control (1)), the power supply 107 starts (turns on) supply of the driver power supply voltage VDR. As a result, the control circuit SC starts the operation. Since the power supply 107 continues to stop (turn off) the supply of the LED power supply voltage VLED, however, the control circuit SC controls the switch circuit SW to bring about conduction between the LED drive terminal TLED and the third switch terminal "c" in response to the control signal SPCON.

In other words, no current flows through the LEDs and the LEDs remain in the off-state (the LEDs do not emit light).

Since the power supply 107 stops (turns off) the supply of the LED power supply voltage VLED, the LED drive terminal TLED is supplied with, for example, the ground voltage (0 V).

In a time period between time t2 and t3 (extinguishment control (2)), the power supply 107 starts (turns on) the supply of the LED power supply voltage VLED. At this time, the control circuit SC controls the switch circuit SW to bring about conduction between the LED drive terminal TLED and the second switch terminal "b" in response to the control signal SPCON.

As for the second current i2, a value which brings the luminous intensity of the LEDs 110 to a very low level is selected. Therefore, conduction is brought between the LED drive terminal TLED and the second switch terminal "b" to let the second current i2 flow. However, the LEDs emit little light.

Since the supply of the LED power supply voltage VLED is started (turned off), the first voltage value is applied to the LED drive terminal TLED. The voltage (the first voltage value) at the LED drive terminal TLED is a voltage lower than the withstand voltage of the LED driver circuit 100. Therefore, dielectric insulation is not caused in the LED driver circuit 100.

Then, in a period between time t3 and t4 (lighting control), the control circuit SC controls the switch circuit SW to bring about conduction between the LED drive terminal TLED and the first switch terminal "a" in response to the control signal SPCON.

Therefore, conduction is brought about between the LED drive terminal TLED and the first switch terminal "a," the first current i1 flows through the LEDs 110, and the LEDs 110 emit light with a predetermined luminous intensity.

Since the first current i1 is greater than the second current i2 as already described, the voltage drop across the whole of the LEDs 110 connected in series becomes greater and consequently a voltage greater than the withstand voltage of the LED driver circuit 100 is not applied to the LED drive terminal TLED.

Thereafter, the lighting control and the extinguishment control are executed during a period between time t4 and t11 in the same way.

And in a time period between time t11 and t12 (extinguishment control (1)), the power supply 107 stops (turns off) the supply of the LED power supply voltage VLED. At this time, the control circuit SC controls the switch circuit SW to be¥ring about conduction between the LED drive terminal TLED and the third switch terminal "c" in response to the control signal SPCON.

In other words, no current flows through the LEDs 110 and the LEDs 110 turn off (the LEDs 110 do not emit light).

Since the power supply 107 stops (turns off) the supply of the LED power supply voltage VLED, for example, the ground voltage (0 V) is applied to the LED drive terminal TLED.

Finally, after t12 (extinguishment control (1)), the power supply 107 stops (turns off) the supply of the driver power supply voltage VDR and the LED power supply voltage VLED. As a result, the LED driver circuit 100 stops the operation and the changeover state of the switch circuit SW becomes an indefinite state.

Since the power supply 107 stops (turns off) the supply of the LED power supply voltage VLED, for example, the ground voltage (0 V) is applied to the LED drive terminal TLED.

According to the LED driver circuit in the present embodiment, the operation of the multi-stage LEDs connected in series can be controlled with a lower withstand voltage.

In other words, since an LED driver circuit having a driver structure of low withstand voltage can be used for control of multi-stage LEDs connected in series, the cost of the LED driver circuit can be reduced.

Second Embodiment

In the present second embodiment, an example of a configuration in which the LED driver circuit has a plurality of sets each including an LED drive terminal and a current switch circuit will be described.

Figure 6:
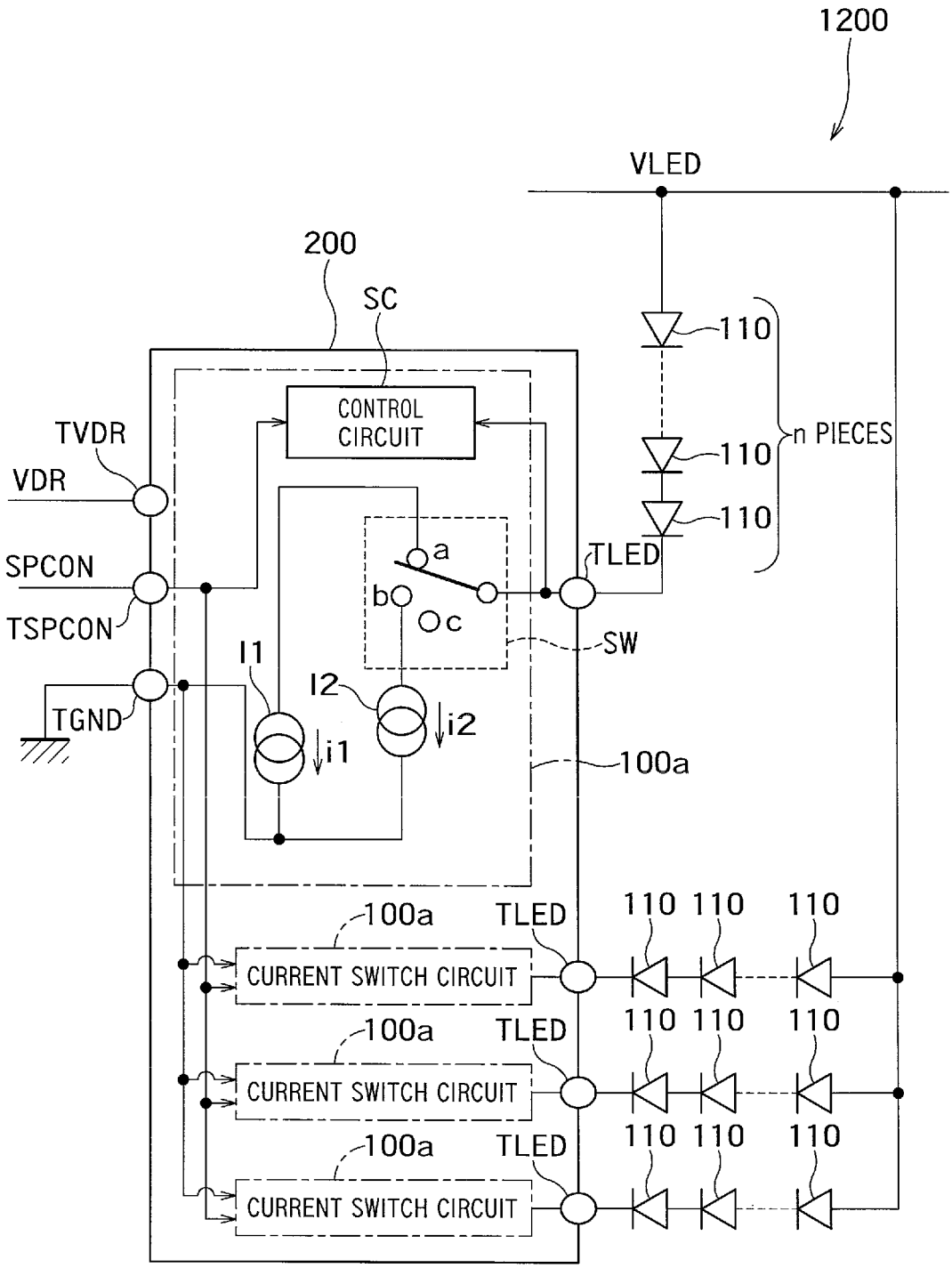
FIG. 6 is a diagram showing an example of a configuration of an LED driver circuit 200 according to the second embodiment.

FIG. 6 is a diagram showing an example of a configuration of an LED driver circuit 200 according to the second embodiment. In FIG. 6, the same reference numerals as those in FIG. 1 denote similar configurations in the first embodiment.

The LED driver circuit 200 shown in FIG. 6 is applied to the digital TV set 1000 shown in FIG. 1 in the same way as the LED driver circuit 100 in the first embodiment.

As shown in FIG. 6, the LED driver circuit 200 includes a power supply terminal TVDR, a ground terminal TGND, a control signal terminal TSPCON, a plurality of (four example, in the example shown in FIG. 6, four) LED drive terminals TLED, and a plurality of (four example, in the example shown in FIG. 6, four) current switch circuits 100*a*.

The LED driver circuit 200 is adapted to control currents flowing through a plurality of sets each having a plurality of LEDs 110 connected in series by using corresponding current switch circuits 100*a*, respectively and thereby control operations of the sets of LEDs 110.

The LED driver circuit 200 is the same as the LED driver circuit 100 in the first embodiment except that the LED driver circuit 200 includes a plurality of sets each having the LED drive terminal TLED and the current switch circuit 100*a*.

The LED driver circuit 200 and a plurality of LEDs 110 constitute an LED driver system 1200.

Furthermore, operation of the current switch circuit 100*a* in each set in the LED driver circuit 200 is the same as the operation of the current switch circuit 100*a* in the first embodiment.

According to the LED driver circuit in the present embodiment, the operation of the multi-stage LEDs connected in series can be controlled with a lower withstand voltage in the same way as the first embodiment as described heretofore.

In other words, since an LED driver circuit having a driver structure of low withstand voltage can be used for control of multi-stage LEDs connected in series, the cost of the LED driver circuit can be reduced in the same way as the first embodiment.

Third Embodiment

In the present third embodiment, an example of a configuration in which the LED driver circuit has a resistor through which a minute current flows, as the second constant current circuit I2 will be described.

Figure 7:
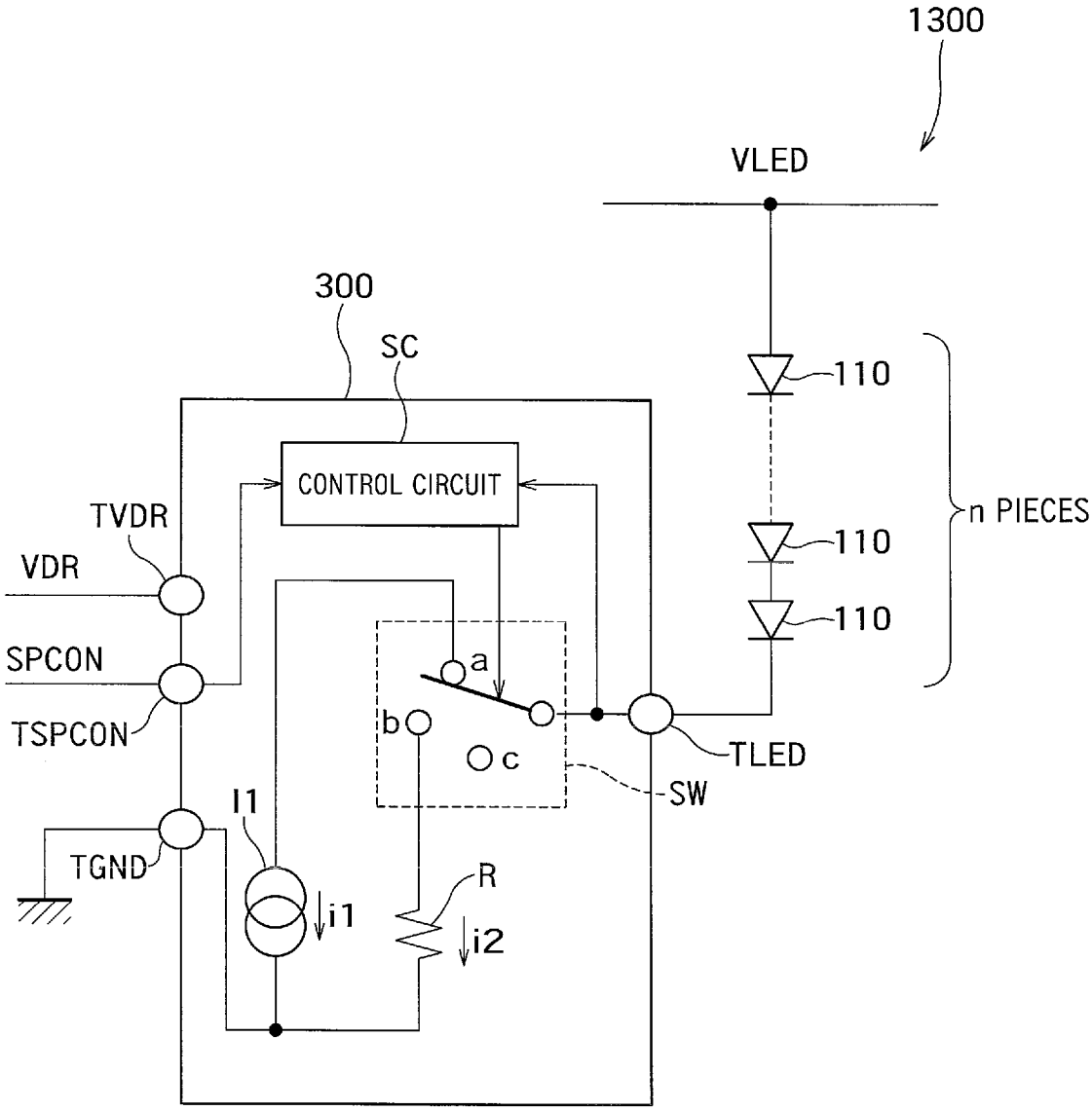
FIG. 7 is a diagram showing an example of a configuration of an LED driver circuit 300 according to the third embodiment.

FIG. 7 is a diagram showing an example of a configuration of an LED driver circuit 300 according to the third embodiment. In FIG. 7, the same reference numerals as those in FIG. 1 denote similar configurations in the first embodiment.

The LED driver circuit 300 shown in FIG. 7 is applied to the digital TV set 1000 shown in FIG. 1 in the same way as the LED driver circuit 100 in the first embodiment.

The LED driver circuit 300 is adapted to control operation of a plurality of LEDs 110 connected in series and connected at a first end (anode side) of the series connection to the power supply 107 by controlling a current flowing through the LEDs 110.

As shown in FIG. 7, the LED driver circuit 300 includes a power supply terminal TVDR, a ground terminal TGND, a control signal terminal TSPCON, an LED drive terminal TLED, a switch circuit SW, a first constant current circuit I1, a resistor R which functions as a second constant current circuit, and a control circuit SC.

The switch circuit SW has a first switch terminal "a" connected to a first end of the first constant current circuit I1, a second switch terminal "b" connected to a first end of the resistor R which functions as the second constant current circuit, and a third switch terminal "c" in a floating state.

The resistor R is connected between the second switch terminal "b" and the ground (the ground terminal GND). The resistor R is adapted to let a second current i2 which is smaller than the first current i1 flow if the switch circuit SW brings about conduction between the LED drive terminal TLED and the second switch terminal "b" in a state in which the LED power supply voltage VLED is supplied.

The LED driver circuit 300 is the same as the LED driver circuit 100 in the first embodiment except that the second constant current circuit is the resistor R.

The LED driver circuit 300 and a plurality of LEDs 110 constitute an LED driver system 1300.

Furthermore, operation of the LED driver circuit 300 is the same as that in the first embodiment.

According to the LED driver circuit in the present embodiment, the operation of the multi-stage LEDs connected in series can be controlled with a lower withstand voltage in the same way as the first embodiment as described heretofore.

In other words, since an LED driver circuit having a driver structure of low withstand voltage can be used for control of multi-stage LEDs connected in series, the cost of the LED driver circuit can be reduced in the same way as the first embodiment.

Fourth Embodiment

In the present fourth embodiment, an example of a configuration in which the function of the second constant current circuit I2 is provided outside the LED driver circuit will be described.

Figure 8:
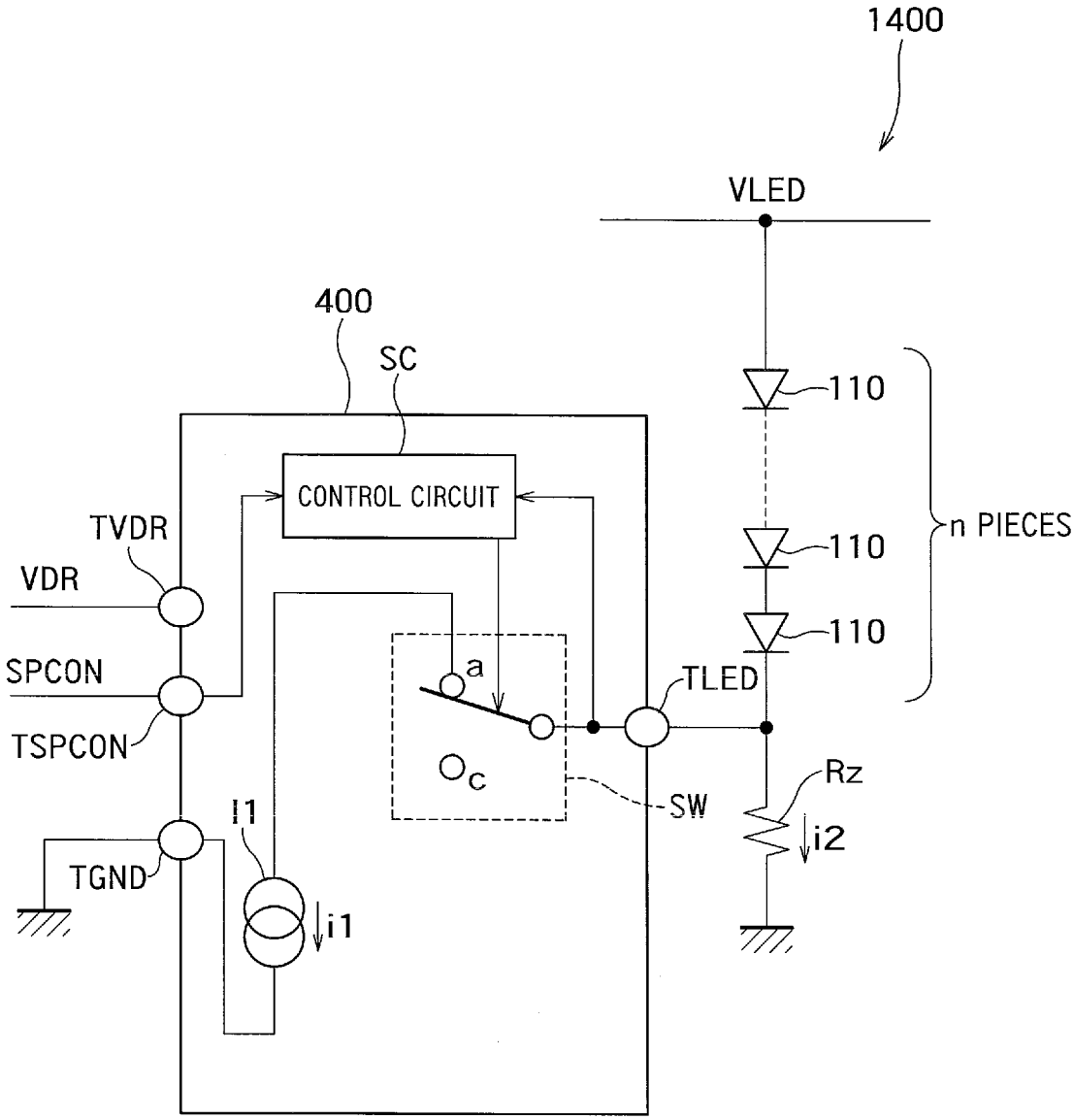
FIG. 8 is a diagram showing an example of a configuration of an LED driver circuit 400 according to the fourth embodiment.

FIG. 8 is a diagram showing an example of a configuration of an LED driver circuit 400 according to the fourth embodiment. In FIG. 8, the same reference numerals as those in FIG. 1 denote similar configurations in the first embodiment.

The LED driver circuit 400 shown in FIG. 8 is applied to the digital TV set 1000 shown in FIG. 1 in the same way as the LED driver circuit 100 in the first embodiment.

The LED driver circuit 400 is adapted to control operation of a plurality of LEDs 110 connected in series and connected at a first end (anode side) of the series connection to the power supply 107 by controlling a current flowing through the LEDs 110.

As shown in FIG. 8, the LED driver circuit 400 includes a power supply terminal TVDR, a ground terminal TGND, a control signal terminal TSPCON, an LED drive terminal TLED, a switch circuit SW, a first constant current circuit I1, and a control circuit SC.

A resistor Rz having the function of the second constant current circuit is connected between a second end (cathode side) of LEDs 110 connected in series and the ground (the ground terminal TGND). This resistor Rz is provided outside the LED driver circuit 400.

The switch circuit SW has a first switch terminal "a" connected to a first end of the first constant current circuit I1, and a third switch terminal "c" in a floating state. In other words, the second switch terminal "b" in the switch circuit SW becomes unnecessary. The state in which conduction is brought about between the second switch terminal "b" and the LED drive terminal TLED as shown in the first embodiment becomes equivalent to a state in which conduction is brought about between the third switch terminal "c" and the LED drive terminal TLED in the present fourth embodiment.

Note that other configurations of the LED driver circuit 400 are the same as those of the LED driver circuit in the first embodiment.

Note that the LED driver circuit 400, the plurality of LEDs 110, and the resistor Rz constitute an LED driver system 1400.

Furthermore, operation of the LED driver circuit 400 is the same as that in the first embodiment except that the state in which conduction is brought about between the second switch terminal "b" and the LED drive terminal TLED as in the first embodiment becomes equivalent to the state in which conduction is brought between the third switch terminal "c" and the LED drive terminal TLED in the present fourth embodiment.

According to the LED driver circuit in the present embodiment, the operation of the multi-stage LEDs connected in series can be controlled with a lower withstand voltage in the same way as the first embodiment as described heretofore.

In other words, since an LED driver circuit having a driver structure of low withstand voltage can be used for control of multi-stage LEDs connected in series, the cost of the LED driver circuit can be reduced in the same way as the first embodiment.

Fifth Embodiment

In the present fifth embodiment, an example of a configuration in which the second current i2 of the second constant current circuit I2 is controlled according to the voltage at the LED drive terminal TLED to prevent the withstand voltage at the LED drive terminal TLED from being exceeded will be described.

Figure 9:
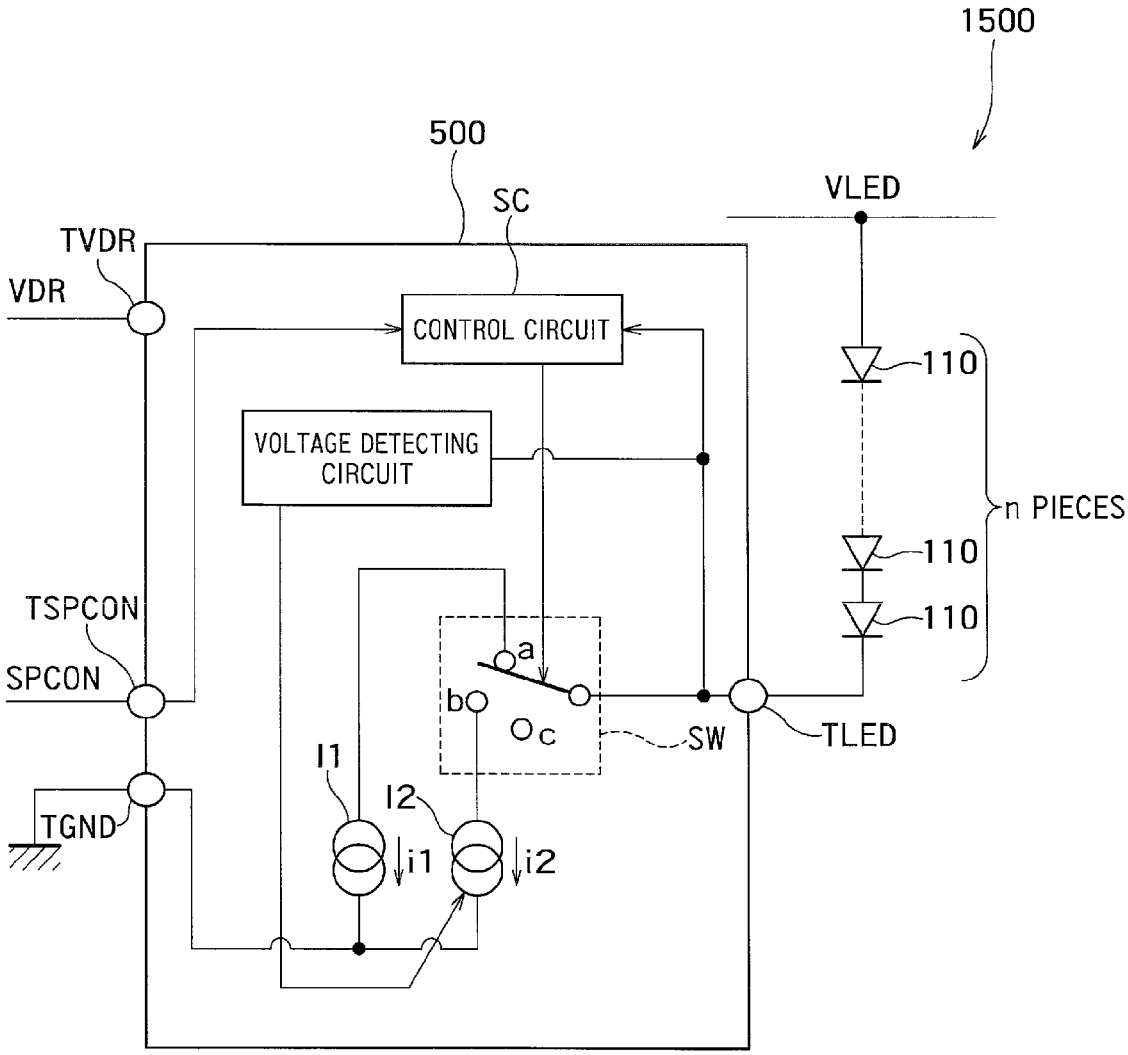
FIG. 9 is a diagram showing an example of a configuration of an LED driver circuit 500 according to the fifth embodiment.

FIG. 9 is a diagram showing an example of a configuration of an LED driver circuit 500 according to the fifth embodiment. In FIG. 9, the same reference numerals as those in FIG. 1 denote similar configurations in the first embodiment.

The LED driver circuit 500 shown in FIG. 9 is applied to the digital TV set 1000 shown in FIG. 1 in the same way as the LED driver circuit 100 in the first embodiment.

As shown in FIG. 9, the LED driver circuit 500 is adapted to control operation of a plurality of LEDs 110 connected in series and connected at a first end (anode side) of the series connection to the power supply 107 by controlling a current flowing through the LEDs 110.

The LED driver circuit 500 includes a power supply terminal TVDR, a ground terminal TGND, a control signal terminal TSPCON, an LED drive terminal TLED, a switch circuit SW, a first constant current circuit I1, a second constant current circuit I2, a control circuit SC, and a voltage detection circuit 501. The voltage detection circuit 501 is adapted to detect a voltage at the LED drive terminal TLED and control a magnitude of the second constant current i2 which is output by the second constant current circuit I2, in accordance with a result of the detection. In other words, the voltage detection circuit 501 controls the magnitude of the second constant current i2 to cause the voltage at the LED drive terminal TLED to become lower than the withstand voltage of the LED driver circuit 100.

As a result, dielectric breakdown of the LED driver circuit can be prevented.

The LED driver circuit 500 is the same as the LED driver circuit 100 in the first embodiment except that the voltage detection circuit 501 is further included The LED driver circuit 500 and a plurality of LEDs 110 constitute an LED driver system 1500.

Furthermore, operation of the LED driver circuit 500 is the same as that in the first embodiment except operation of the voltage detection circuit.

According to the LED driver circuit in the present embodiment, the operation of the multi-stage LEDs connected in series can be controlled with a lower withstand voltage in the same way as the first embodiment as described heretofore.

In other words, since an LED driver circuit having a driver structure of low withstand voltage can be used for control of multi-stage LEDs connected in series, the cost of the LED driver circuit can be reduced in the same way as the first embodiment.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An LED driver circuit which controls operation of a plurality of LEDs connected in series by controlling a current flowing through the plurality of LEDs, a first end of the LEDs connected in series being connected to a power supply, and the LED driver circuit comprising:

an LED drive terminal connected to a second end of the LEDs connected in series;

a switch circuit which has a first switch terminal and a second switch terminal, and which brings about conduction only in one of between the LED drive terminal and the first switch terminal, and between the LED drive terminal and the second switch terminal;

a first constant current circuit connected between the first switch terminal and ground to output a first constant current to be let flow through the LEDs;

a second constant current circuit connected between the second switch terminal and the ground to output a second constant current, the second constant current being smaller than the first constant current; and a control circuit which controls the switch circuit in response to a control signal for controlling a luminous intensity of the LEDs, wherein a withstand voltage of the LED driver circuit is set to be lower than an LED power supply voltage of the power supply and be higher than a first voltage value obtained by subtracting a voltage drop across whole of the LEDs connected in series caused by the second constant current from the LED power supply voltage, when raising a luminous intensity of the LEDs, in response to the control signal, the control circuit controls the switch circuit to bring about conduction between the LED drive terminal and the first switch terminal to let the first constant current flow through the LEDs, and when lowering the luminous intensity of the LEDs, in response to the control signal, the control circuit controls the switch circuit to bring about conduction between the LED drive terminal and the second switch terminal to let the second constant current flow through the LEDs.

2. The LED driver circuit according to claim 1, wherein the switch circuit further comprises a third switch terminal in a floating state, the switch circuit brings about conduction in only one out of between the LED drive terminal and the first switch terminal, between the LED drive terminal and the second switch terminal, and between the LED drive terminal and the third switch terminal, when turning off the LEDs, in response to the control signal, the control circuit controls the switch circuit to bring about conduction between the LED drive terminal and the third switch terminal.

3. The LED driver circuit according to claim 2, further comprising a voltage detection circuit which detects a voltage at the LED drive terminal and controls a magnitude of the second constant current in response to a result of the detection, the second current being output by the second constant current circuit, wherein the voltage detection circuit controls the magnitude of the second constant current to cause the voltage at the LED drive terminal to become lower than the withstand voltage of the LED driver circuit.

4. The LED driver circuit according to claim 3, wherein the withstand voltage of the LED drive terminal and a withstand voltage of the switch circuit are set to be lower than the LED power supply voltage and set to be higher than the first voltage value.

5. The LED driver circuit according to claim 2, wherein the withstand voltage of the LED drive terminal and a withstand voltage of the switch circuit are set to be lower than the LED power supply voltage and set to be higher than the first voltage value.

6. The LED driver circuit according to claim 1, further comprising a voltage detection circuit which detects a voltage at the LED drive terminal and controls a magnitude of the second constant current in response to a result of the detection, the second current being output by the second constant current circuit, wherein the voltage detection circuit controls the magnitude of the second constant current to cause the voltage at the LED drive terminal to become lower than the withstand voltage of the LED driver circuit.

7. The LED driver circuit according to claim 6, wherein the withstand voltage of the LED drive terminal and a withstand voltage of the switch circuit are set to be lower than the LED power supply voltage and set to be higher than the first voltage value.

8. The LED driver circuit according to claim 1, wherein the withstand voltage of the LED drive terminal and a withstand voltage of the switch circuit are set to be lower than the LED power supply voltage and set to be higher than the first voltage value.

9. An LED driver system which controls operation of a plurality of LEDs, the LED driver system comprising:

a plurality of LEDs connected in series and connected at a first end of the plurality of LEDs to a power supply; and an LED driver circuit which controls operation of the LEDs by controlling a current flowing through the LEDs, wherein the LED driver circuit comprising:

an LED drive terminal connected to a second end of the LEDs connected in series;

a switch circuit which has a first switch terminal and a second switch terminal, and which brings about conduction only in one of between the LED drive terminal and the first switch terminal, and between the LED drive terminal and the second switch terminal;

a first constant current circuit connected between the first switch terminal and ground to output a first constant current to be let flow through the LEDs;

a second constant current circuit connected between the second switch terminal and the ground to output a second constant current, the second constant current being smaller than the first constant current; and a control circuit which controls the switch circuit in response to a control signal for controlling a luminous intensity of the LEDs, wherein a withstand voltage of the LED driver circuit is set to be lower than an LED power supply voltage of the power supply and be higher than a first voltage value obtained by subtracting a voltage drop across whole of the LEDs connected in series caused by the second constant current from the LED power supply voltage, when raising a luminous intensity of the LEDs, in response to the control signal, the control circuit controls the switch circuit to bring about conduction between the LED drive terminal and the first switch terminal to let the first constant current flow through the LEDs, and when lowering the luminous intensity of the LEDs, in response to the control signal, the control circuit controls the switch circuit to bring about conduction between the LED drive terminal and the second switch terminal to let the second constant current flow through the LEDs.

10. The LED driver system according to claim 9, wherein the switch circuit further comprises a third switch terminal in a floating state, the switch circuit brings about conduction in only one out of between the LED drive terminal and the first switch terminal, between the LED drive terminal and the second switch terminal, and between the LED drive terminal and the third switch terminal, when turning off the LEDs, in response to the control signal, the control circuit controls the switch circuit to bring about conduction between the LED drive terminal and the third switch terminal.

11. The LED driver system according to claim 10, further comprising a voltage detection circuit which detects a voltage at the LED drive terminal and controls a magnitude of the second constant current in response to a result of the detection, the second current being output by the second constant current circuit, wherein the voltage detection circuit controls the magnitude of the second constant current to cause the voltage at the LED drive terminal to become lower than the withstand voltage of the LED driver circuit.

12. The LED driver system according to claim 11, wherein the withstand voltage of the LED drive terminal and a withstand voltage of the switch circuit are set to be lower than the LED power supply voltage and set to be higher than the first voltage value.

13. The LED driver system according to claim 10, wherein the withstand voltage of the LED drive terminal and a withstand voltage of the switch circuit are set to be lower than the LED power supply voltage and set to be higher than the first voltage value.

14. The LED driver system according to claim 9, further comprising a voltage detection circuit which detects a voltage at the LED drive terminal and controls a magnitude of the second constant current in response to a result of the detection, the second current being output by the second constant current circuit, wherein the voltage detection circuit controls the magnitude of the second constant current to cause the voltage at the LED drive terminal to become lower than the withstand voltage of the LED driver circuit.

15. The LED driver system according to claim 14, wherein the withstand voltage of the LED drive terminal and a withstand voltage of the switch circuit are set to be lower than the LED power supply voltage and set to be higher than the first voltage value.

16. The LED driver system according to claim 9, wherein the withstand voltage of the LED drive terminal and a withstand voltage of the switch circuit are set to be lower than the LED power supply voltage and set to be higher than the first voltage value.

17. An LED driver system which controls operation of a plurality of LEDs, the LED driver system comprising:

a plurality of LEDs connected in series and connected at a first end of the plurality of LEDs to a power supply;

a resistor connected between a second end of the LEDs connected in series and ground; and an LED driver circuit which controls operation of the LEDs by controlling a current flowing through the LEDs, wherein the LED driver circuit comprising:

an LED drive terminal connected to a second end of the LEDs connected in series;

a switch circuit which has a first switch terminal and a second switch terminal, and which brings about conduction only in one of between the LED drive terminal and the first switch terminal, and between the LED drive terminal and the second switch terminal;

a first constant current circuit connected between the first switch terminal and ground to output a first constant current to be let flow through the LEDs; and a control circuit which controls the switch circuit in response to a control signal for controlling a luminous intensity of the LEDs, wherein a withstand voltage of the LED driver circuit is set to be lower than an LED power supply voltage of the power supply and be higher than a first voltage value obtained by subtracting a voltage drop across whole of the LEDs connected in series caused by a second constant current from the LED power supply voltage, when raising a luminous intensity of the LEDs, in response to the control signal, the control circuit controls the switch circuit to bring about conduction between the LED drive terminal and the first switch terminal to let the first constant current flow through the LEDs, and when lowering the luminous intensity of the LEDs, in response to the control signal, the control circuit controls the switch circuit to bring about conduction between the LED drive terminal and the second switch terminal to let the second constant current flow through the LEDs.

18. The LED driver system according to claim 17, wherein the withstand voltage of the LED drive terminal and a withstand voltage of the switch circuit are set to be lower than the LED power supply voltage and set to be higher than the first voltage value.

* * * * *